US008729781B2

(12) United States Patent
Ter Weeme et al.

(10) Patent No.: US 8,729,781 B2
(45) Date of Patent: May 20, 2014

(54) ELECTRIC LAMP HAVING REFLECTOR FOR TRANSFERRING HEAT FROM LIGHT SOURCE

(75) Inventors: Berend Jan Willem Ter Weeme, Eindhoven (NL); Johannes Petrus Maria Ansems, Hulsel (NL); Salvatore Cassarino, Patterson, CA (US); Rudolf Georg Hechfellner, Campbell, CA (US)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/582,417

(22) PCT Filed: Feb. 28, 2011

(86) PCT No.: PCT/IB2011/050841

§ 371 (c)(1),
(2), (4) Date: Sep. 1, 2012

(87) PCT Pub. No.: WO2011/107925

PCT Pub. Date: Sep. 9, 2011

(65) Prior Publication Data

US 2012/0319554 A1 Dec. 20, 2012

Related U.S. Application Data

(60) Provisional application No. 61/310,125, filed on Mar. 3, 2010.

(51) Int. Cl.

| | |
|---|---|
| ***H01J 1/02*** | (2006.01) |
| ***H01J 7/24*** | (2006.01) |
| ***H01J 61/52*** | (2006.01) |
| ***H01K 1/58*** | (2006.01) |

(52) U.S. Cl.

USPC ..... 313/46; 362/296.01; 362/296.05; 362/311.01; 362/311.02; 362/311.06; 362/341; 362/345

(58) Field of Classification Search

USPC ..... 362/227, 294, 249.02, 296.01, 311.02, 362/341, 345, 373; 313/46

See application file for complete search history.

(56) References Cited

U.S. PATENT DOCUMENTS

| | | | | |
|---|---|---|---|---|
| 5,726,535 | A | 3/1998 | Yan | |
| 7,018,065 | B2 * | 3/2006 | Tamai | 362/247 |
| 2003/0039122 | A1 * | 2/2003 | Cao | 362/294 |

(Continued)

FOREIGN PATENT DOCUMENTS

| | | | |
|---|---|---|---|
| GB | 2401928 | A | 11/2004 |
| JP | 2005166937 | A | 6/2005 |
| WO | 2009063655 | A1 | 5/2009 |

OTHER PUBLICATIONS

LED Professional; Section Entitled Two Optimization Blocks: Professional Review, Mar./Apr. 2009, p. 2, p. 3, Section Entitled "Ceramic : Two Jobs in One Material". p. 5, Section Entitled "Retrofit Lamps and Isolation". www.led-professional.com, Mar./Apr. 2009; Luger Research & LED-Professional. pp. 1-6.

*Primary Examiner* — Donald Raleigh
(74) *Attorney, Agent, or Firm* — Mark L. Beloborodov

(57) ABSTRACT

The invention relates to an electric lamp (102) comprising a primary semiconductor light source (104) in thermal communication with a primary reflector (106). Herein, the primary reflector (106) is reflective, transparent and/or translucent. The primary reflector (106) is configured for transferring heat generated by the primary semiconductor light source (104) during operation away from said primary semiconductor light source (104). As a result, the electric lamp (102) according to the invention effectively reduces the number of parts comprised in the electric lamp (102), thereby lowering the costs of manufacturing the electric lamp (102).

13 Claims, 4 Drawing Sheets

(56) References Cited

U.S. PATENT DOCUMENTS

Figure 1A:
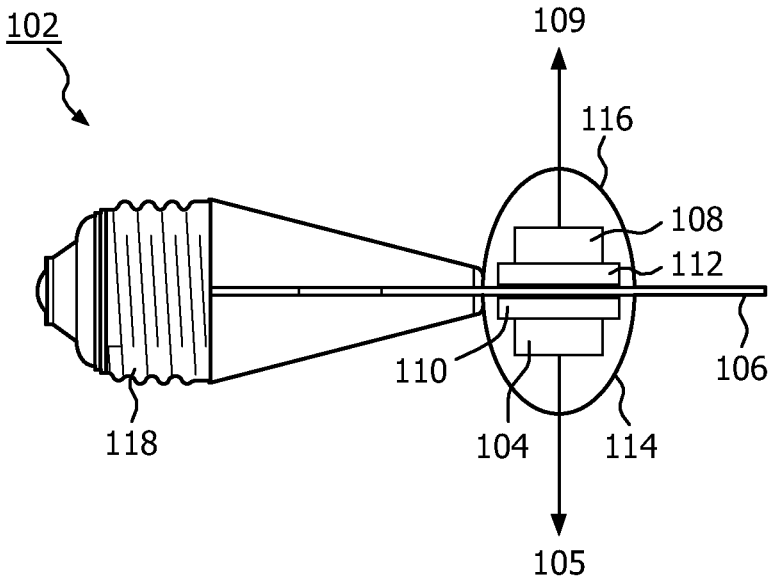

| | | | | |
|---|---|---|---|---|
| 2006/0001384 | A1 | 1/2006 | Tain et al. | |
| 2006/0193130 | A1* | 8/2006 | Ishibashi | 362/227 |
| 2008/0144322 | A1 | 6/2008 | Norfidathul et al. | |
| 2009/0103296 | A1* | 4/2009 | Harbers et al. | 362/234 |
| 2009/0196045 | A1 | 8/2009 | Shuai et al. | |
| 2010/0102697 | A1* | 4/2010 | Van De Ven et al. | 313/46 |
| 2011/0080096 | A1* | 4/2011 | Dudik et al. | 315/112 |
| 2011/0110098 | A1* | 5/2011 | Fu et al. | 362/308 |

* cited by examiner

ELECTRIC LAMP HAVING REFLECTOR FOR TRANSFERRING HEAT FROM LIGHT SOURCE

FIELD OF THE INVENTION

The invention relates to an electric lamp.

BACKGROUND OF THE INVENTION

US-A 2006/001384 A1 discloses a LED lamp including bare LED chips and a lamp shade. The bare LED chips are mounted on the outer surface of an axle extending through the lamp shade. The axle accommodates a heat pipe for dissipating heat generated by the LED chips. For this purpose, the heat pipe may be provided with a heat receiving portion and a heat dissipation portion, between which portions heat is transferred via liquid and gas phase transitions of a fluid sealed inside the pipe. The dissipation portion dissipates heat to the surroundings of the LED lamp via natural or forced convection.

A disadvantage of the LED lamp disclosed in US-A 2006/001384 A1 is in its rather complex and hence expensive facility for removing heat from the LED chips.

SUMMARY OF THE INVENTION

It is an object of the electric lamp according to the invention to counteract at least one of the disadvantages of the known electric lamp. This object is achieved by the electric lamp according to the invention, which electric lamp comprises a primary semiconductor light source in thermal communication with a primary reflector, wherein the primary reflector is reflective, transparent and/or translucent, and wherein the primary reflector is configured for transferring heat generated by the primary semiconductor light source during operation away from said primary semiconductor light source.

As the primary reflector is configured for either reflecting or allowing to pass trough light generated by the primary semiconductor light source, as well as for transferring away heat generated by said primary semiconductor light source, the primary reflector effectively integrates the functionality of a lamp shade and the functional character of a heat sink into one single element. As a result, the electric lamp according to the invention effectively reduces the number of parts comprised in an electric lamp, thereby simplifying the construction of an electric lamp as well as lowering the costs associated with manufacturing said electric lamp.

The primary reflector is reflective, transparent and/or translucent. Hence, for example, a first part of the primary reflector may be reflective whereas a second part of the primary reflector may be transparent. Basically, the primary reflector may be provided with any combination of the aforementioned optical properties. The primary reflector is not to absorb the light generated during operation by the primary semiconductor light source.

In this text, a semiconductor light source includes, but is not limited to, Light Emitting Diodes (LEDs), Organic Light Emitting Diodes (OLEDs) and opto-electrical devices.

In this text, thermal communication between objects means that said objects are connectable via heat transfer. The latter heat transfer causes the temperatures of the objects to mutually correlate. In practice, this means that fluctuations in a first temperature, i.e. the temperature of a first object, are similarly followed by a second temperature, i.e. the temperature of a second object. In this text, said mutual correlation of temperatures implies that fluctuations in the first temperature are followed by the second temperature according to a thermal process having a time constant smaller than one hour. Preferably said time constant is smaller than 10 minutes, more preferably it is smaller than 1 minute. A significant thermal resistance, i.e. a thermal isolation, installed between objects prevents them from being in thermal communication. In this text, thermal communication between objects requires any thermal resistance present there between to be smaller than 10 K/W.

In this text, a reflector is not limited to having a particular geometry. However, if the reflector is reflective, the geometry of the reflector is confined to the extent that it allows for reflecting the light generated by the semiconductor light source during operation. In this text, the reflectance of light is defined with respect to the primary optical axis of the primary semiconductor light source which is an imaginary vector whose orientation coincides with the axis along which there is rotational symmetry with respect to the light intensity distribution of the primary semiconductor light source, and whose direction coincides with the direction at which most light propagates from the primary semiconductor light source. Reflection is obtained if at least 80% of the light emitted in a backward direction, i.e. a direction having a component opposite to the direction of the primary optical axis, is reflected along a direction having a component equal to the direction of the primary optical axis. Preferably, the primary reflector is arranged substantially perpendicular to the primary optical axis. As an example, a plate like geometry will for prove useful for reflecting light produced by the primary semiconductor light source, provided the plate and the primary semiconductor light source are mutually situated such that light emitted in backward direction indeed arrives at the plate rather than passing by the plate. In this text, a plate is understood to imply a geometry that is flat, slightly curved or substantially curved, and for which the ratio of in-plane dimensions to the thickness is substantially large, i.e. exceeding 10. Hence, the rim of the plate seems less appropriate for the purpose of reflecting light generated by the primary semiconductor light source.

Examples of materials having relatively high thermal conductivity and providing significant reflection are metals such as aluminum or chromium. Alternatively, metals provided with a reflective coating based on e.g. aluminum, titanium dioxide, aluminum oxide or barium sulphate may be successfully employed. A material suitable for manufacturing a translucent primary reflector is Poly Crystalline Aluminum (PCA).

A preferred embodiment of the electric lamp according to the invention comprises a printed circuit board for materializing thermal communication between the primary semiconductor light source and the primary reflector. A printed circuit board provides for significant contact area between the primary semiconductor light source and the primary reflector, thereby materializing substantially thermal conductivity between the primary semiconductor light source and the primary reflector. Therefore, this embodiment is advantageous in that it further facilitates the thermal communication between the primary semiconductor light source and the primary reflector.

A further preferred embodiment of the electric lamp according to the invention comprises a cage for mechanically connecting the primary reflector to a socket. This embodiment increases the area of the primary reflector that is exposed to a fluid, i.e. air, thereby increasing heat transfer via convection from the primary reflector towards the surrounding air. As a result, this embodiment advantageously increases the ability of the primary reflector to transfer away heat from the primary semiconductor light source.

A further preferred embodiment of the electric lamp according to the invention comprises a secondary semiconductor light source in thermal communication with the primary reflector, wherein the primary and secondary semiconductor light sources are situated on mutually opposite sides relative to the primary reflector. This embodiment has the advantage of generating more light during operation.

A further preferred embodiment of the electric lamp according to the invention comprises a secondary semiconductor light source in thermal communication with a secondary reflector, wherein the secondary reflector is reflective, transparent and/or translucent, and wherein secondary reflector is configured for transferring heat generated by the secondary semiconductor light source during operation away from said secondary semiconductor light source. This embodiment advantageously allows for increasing the amount of light producible by the electric lamp while maintaining to some extent the surface area available per semiconductor light source for transferring away heat via convection.

In a practical embodiment of the electric lamp according to the invention, the primary reflector and the secondary reflector are mutually substantially parallel. In this text, objects are considered to be substantially parallel if the distance between said objects varies no more than 10% relative to the length the objects measure along the direction along which the objects are parallel.

In a further preferred embodiment of the electric lamp according to the invention, a distance between the primary reflector and the secondary reflector is larger than 6 mm and smaller than 8 mm if the primary reflector and the secondary reflector are reflective. Through selecting the distance no larger than 8 mm, the distribution of the light generated by the primary and the secondary semiconductor is negligibly disturbed by the distance between the reflective primary and secondary reflectors. By choosing the distance no smaller than 6 mm, transfer of heat from the primary and secondary reflectors via natural convection is enabled. Therefore, this embodiment is advantageous in that it significantly increases the capability of the electric lamp to remove heat from the semiconductor light sources without disturbing the light distribution.

In a further preferred embodiment of the electric lamp according to the invention, a distance between the primary reflector and the secondary reflector is larger than 6 mm and smaller than 15 mm if the primary reflector and the secondary reflector are transparent and/or translucent. Through selecting the distance smaller than 15 mm, the distribution of the light generated by the primary and the secondary semiconductor is negligibly disturbed by the distance between the transparent and/or translucent primary and secondary reflectors. By choosing the distance larger than 6 mm, transfer of heat from the primary and secondary reflectors via natural convection is enabled. Therefore, this embodiment is advantageous in that it significantly increases the capability of the electric lamp to remove heat from the semiconductor light sources without disturbing the light distribution.

In a further preferred embodiment of the electric lamp according to the invention, the primary semiconductor light source is situated on a side of the primary reflector facing away from the secondary reflector, and wherein the secondary semiconductor light source is situated on a side of the secondary reflector facing away from the primary reflector. In this embodiment, radiation induced heating of the primary reflector by the secondary semiconductor light source, as well as radiation induced heating of the secondary reflector by the primary semiconductor light source, are effectively minimized. As a result, this embodiment advantageously increases the efficiency with which the primary reflector is enabled to remove heat from the primary semiconductor light source, as well as the efficiency with which the secondary reflector is enabled to remove heat from the secondary semiconductor light source.

In a further preferred embodiment of the electric lamp according to the invention, the primary reflector comprises a covered surface area which is covered by the primary semiconductor light source and a further surface area, and wherein the further surface area is larger than the covered surface area. This embodiment enables the primary reflector to have significant area available for reflecting light and for transferring heat via convection. Therefore this embodiment is advantageous in that it makes the functionality of the primary reflector robust for the dimensions of the primary semiconductor light source.

In a further preferred embodiment of the electric lamp according to the invention, the primary reflector comprises ceramic material. Ceramic materials are marked by having a relatively high reflectivity while providing sufficient thermal conductivity. Therefore this embodiment has the advantage of omitting the need for providing the primary reflector with a reflective coating, thereby reducing the number of processing steps required for manufacturing the electric lamp.

In a further preferred embodiment of the electric lamp according to the invention, the primary reflector is configured for performing as a ceramic printed circuit board. Owing to the significant electrical resistance present in ceramic materials, this embodiment advantageously enables integration of the printed circuit board and the primary reflector, thereby further reducing the number of components comprised in the electric lamp.

A further practical embodiment of the electric lamp according to the invention comprises a transparent optical chamber mounted to the primary reflector for accommodating the semiconductor light source.

In a further preferred embodiment of the electric lamp according to the invention, the transparent optical chamber comprises transparent ceramic material. Since the thermal conduction of transparent ceramic materials largely exceeds the thermal conduction associated with commonly used transparent materials such as plastics or glass, in this embodiment the transparent optical chamber additionally performs as a heat sink. As a result, this embodiment allows for more effectively cooling the primary semiconductor light source.

SHORT DESCRIPTION OF THE FIGURES

FIG. 1A schematically depicts an embodiment of the electric lamp according to the invention comprising primary and secondary semiconductor light sources.

Figure 1B:
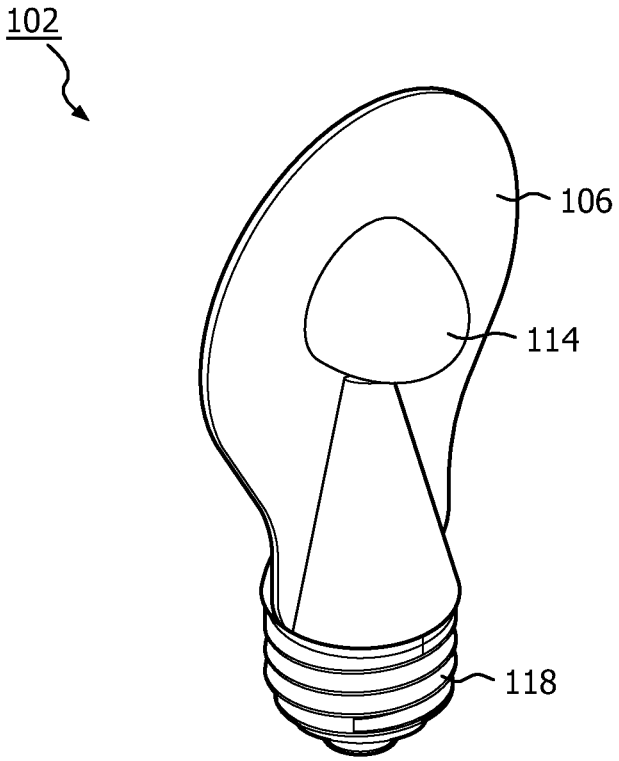

FIG. 1B provides a three-dimensional image of the embodiment depicted in FIG. 1A.

Figure 2A:
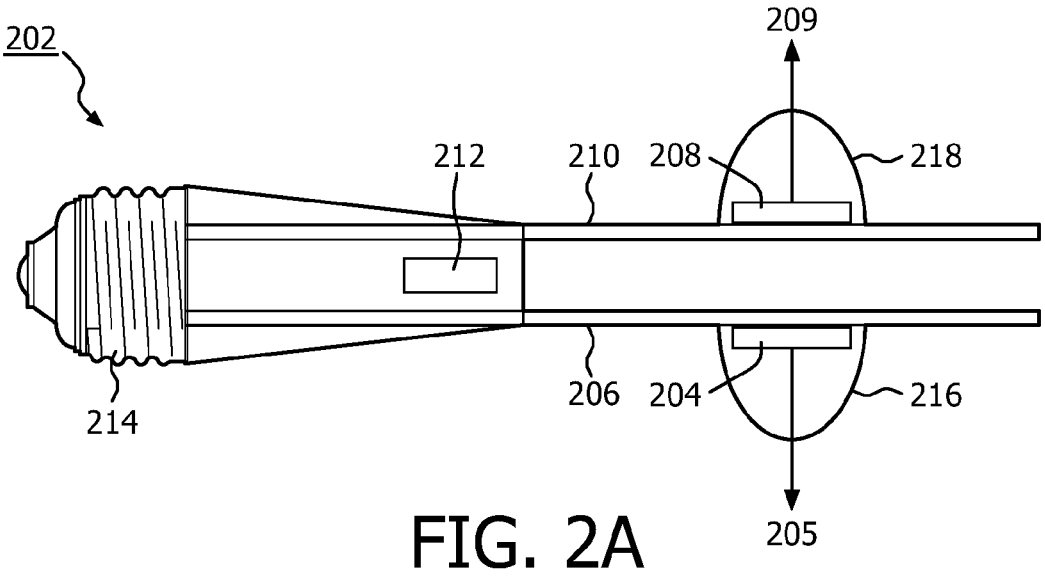

FIG. 2A schematically displays an embodiment of the electric lamp according to the invention comprising primary and secondary reflectors.

Figure 2B:
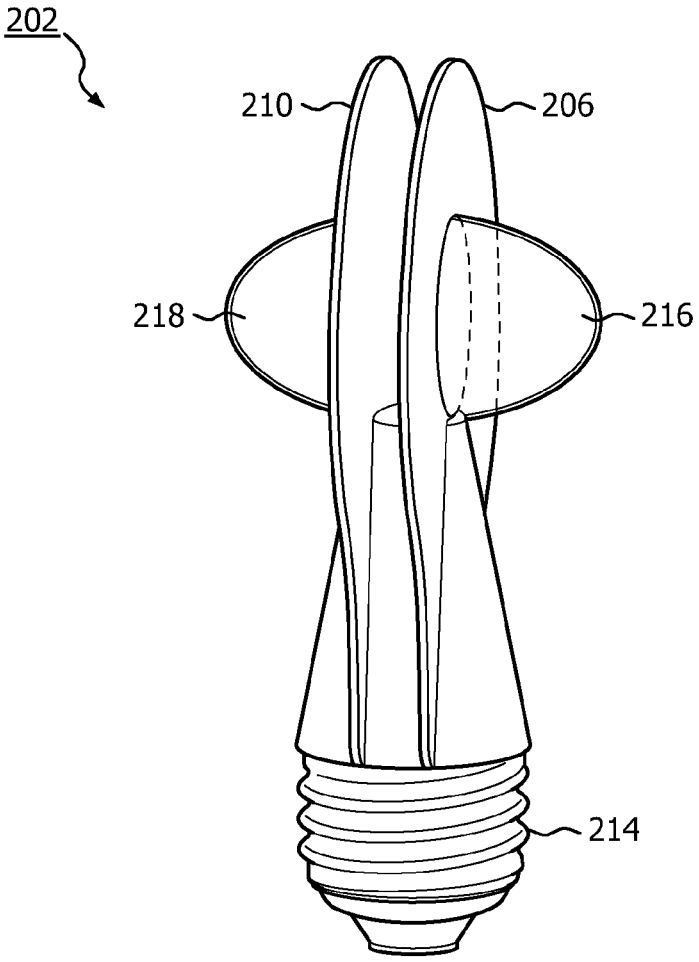

FIG. 2B provides a three-dimensional image of the embodiment depicted in FIG. 2A.

Figure 3:
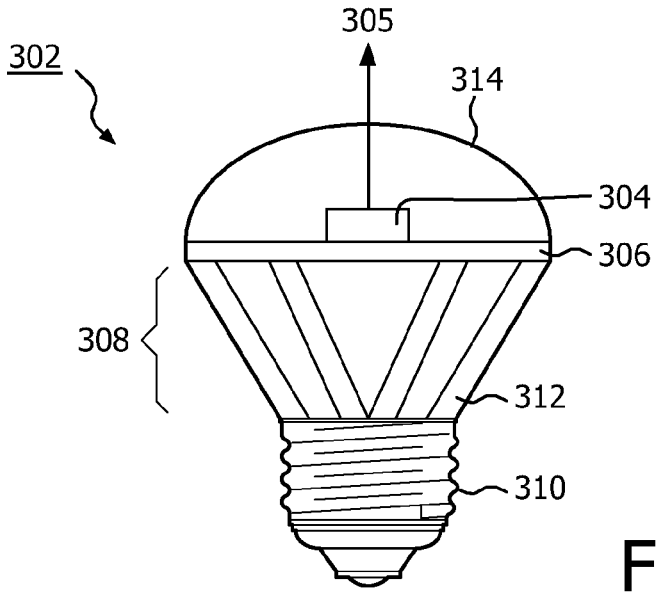

FIG. 3 schematically shows an electric lamp comprising a cage for mechanically connecting a primary reflector to a socket.

Figure 4:
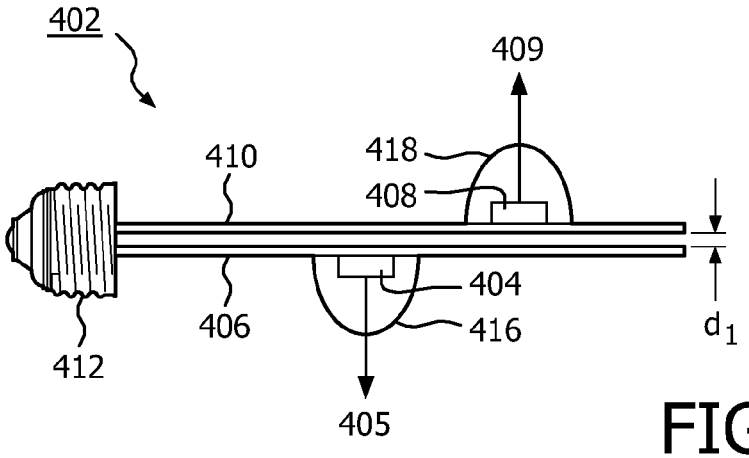

FIG. 4 schematically displays an embodiment of the electric lamp according to the invention comprising mutually parallel primary and secondary reflectors, mutually arranged at a distance substantially equal to a thickness of the primary reflector and a thickness of the secondary reflector.

Figure 5:
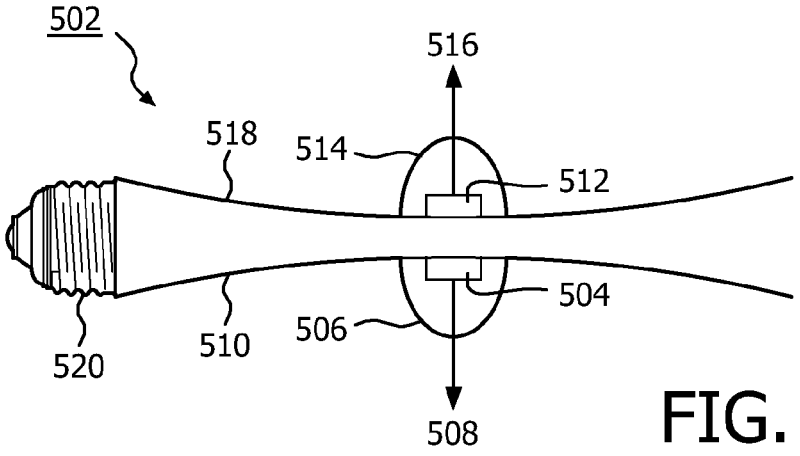

FIG. 5 schematically depicts an embodiment of the electric lamp according to the invention comprising substantially curved primary and secondary reflectors.

Figure 6:
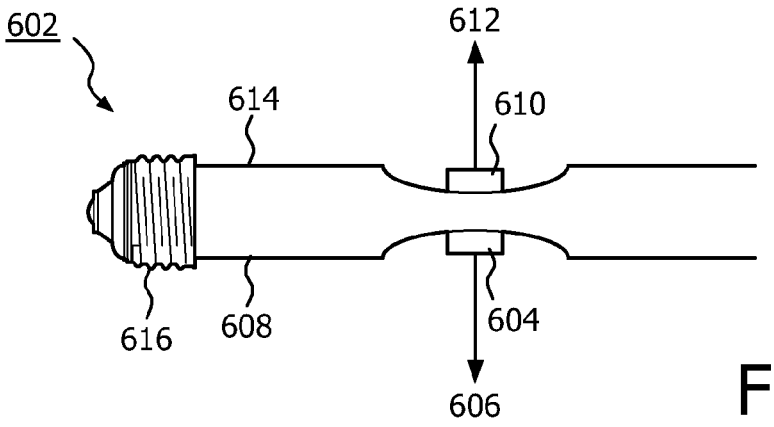

FIG. 6 schematically displays an embodiment of the electric lamp according to the invention comprising primary and secondary reflectors provided with indentations surrounding the primary and secondary semiconductor light sources.

Figure 7A:
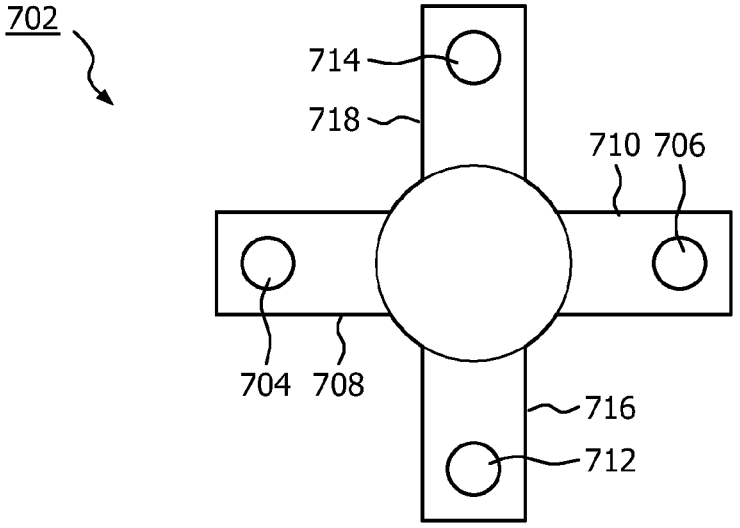

FIG. 7A schematically depicts a bottom view of an embodiment of the electric lamp according to the invention comprising four substantially curved reflectors.

Figure 7B:
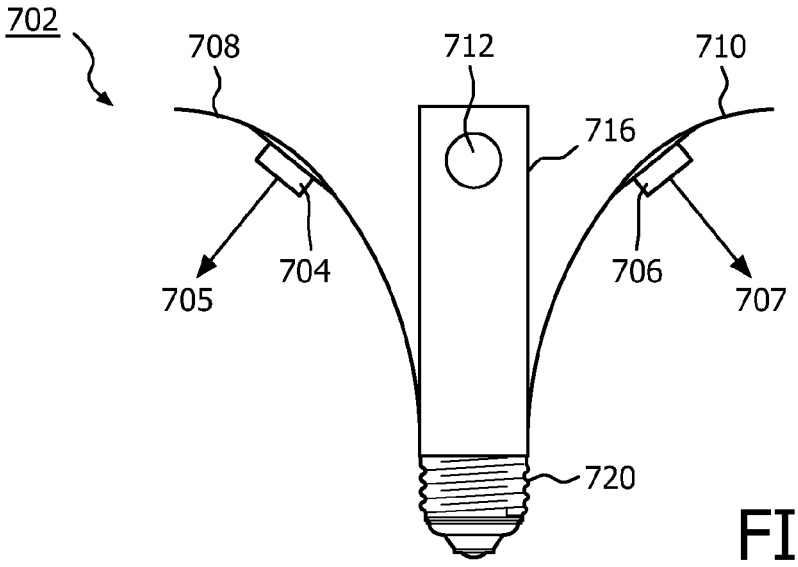

FIG. 7B schematically displays a plan view of the embodiment depicted in FIG. 7A.

DETAILED DESCRIPTION OF THE EMBODIMENTS

FIG. 1A schematically depicts an electric lamp 102 comprising a primary semiconductor light source 104 having a primary optical axis 105, and being in thermal communication with a reflective primary reflector 106. The primary reflector is configured for reflecting light generated by the primary semiconductor light source 104 during operation. For that purpose, the primary reflector 106 may be manufactured from a ceramic material. Additionally, the primary reflector 106 is arranged for transferring away heat generated by said primary semiconductor light source 104 during operation. In a further embodiment, the primary reflector 106 comprises a covered surface area which is covered by the primary semiconductor light source 104 and a further surface area, and wherein the further surface area is larger than the covered surface area, preferably two times larger and more preferably three times larger. In this specific example, the electric lamp 102 furthermore comprises a secondary semiconductor light source 108 having a secondary optical axis 109. Herein, the primary and secondary semiconductor light sources 104 and 108 are situated on mutually opposite sides of the primary reflector 106. In this particular example, a primary printed circuit board 110 is situated between the primary semiconductor light source 104 and the primary reflector 106 as to provide thermal communication there between. Likewise, a secondary printed circuit board 112 is installed between the secondary semiconductor light source 108 and the primary reflector 106 for the purpose of thermal communication between. Optionally, transparent optical chambers 114 and 116 are mounted to the primary reflector 106 for accommodating the primary and secondary semiconductor light sources 104 and 108, respectively. Preferably, the transparent optical chambers 114 and 116 are manufactured from a transparent ceramic material such as aluminum oxide. The primary reflector 106 may be mechanically connected to a socket 118, which socket 118 is arranged for providing electrical energy to the primary and secondary semiconductor light sources 104 and 108 via the primary and secondary printed circuit boards 110 and 112, respectively.

FIG. 2A schematically depicts an electric lamp 202 comprising a primary semiconductor light source 204 having a primary optical axis 205, and being in thermal communication with a primary reflector 206. Said primary reflector 206 is arranged for transferring away heat generated by the primary semiconductor light source 204 during operation. The electric lamp furthermore comprises a secondary semiconductor light source 208 having a secondary optical axis 209, and being in thermal communication with a secondary reflector 210. The secondary reflector 210 is configured for transferring away heat generated by the secondary semiconductor light source 208 during operation. In this particular embodiment, the primary and secondary reflectors 206 and 210 are mounted in a mutually substantially parallel configuration. Herein, the primary semiconductor light source 204 is situated on a side of the primary reflector 206 facing away from the secondary reflector 210, whereas the secondary semiconductor light source 208 is situated on a side of the secondary reflector 210 facing away from the primary reflector 206. The primary and secondary semiconductor light sources 204 and 208 are in electrical connection with a printed circuit board 212, which printed circuit board may be provided with electrical power via a socket 214. Alternatively, a battery may be employed for the purpose of providing electrical power to the printed circuit board 212. Optionally, transparent optical chambers 216 and 218 are mounted to the primary reflector 206 and the secondary reflector 210, respectively, for accommodating the primary and secondary semiconductor light sources 204 and 208. In this particular embodiment an area of the primary reflector 206 underneath the optical chamber 216 is reflective. The remaining area of the primary reflector 206 is transparent. Likewise, an area of the secondary reflector 210 underneath the optical chamber 218 is reflective whereas the remaining area of the primary reflector 210 is transparent.

FIG. 3 schematically depicts an electric lamp 302 comprising a primary semiconductor light source 304 having a primary optical axis 305 and thermally connected to a reflective primary reflector 306. The primary reflector 306 is capable both of reflecting light generated by the primary semiconductor light source 304 during operation and of transferring away heat generated by the semiconductor light source 304 during operational conditions. The primary reflector 306 is mechanically connected to a socket 310 via a cage 308. Herein, said cage 3080 is generally an open structure, for instance a structure comprising a plurality of bars 312. A primary transparent optical chamber 314 may be mounted to the primary reflector 306. Preferably the primary transparent optical chamber 314 is manufactured from a transparent ceramic material as to increase heat transfer.

FIG. 4 schematically depicts an electric lamp 402 comprising a primary semiconductor light source 404 in thermal communication with a translucent primary reflector 406. Said primary reflector 406 is arranged for transferring away heat generated by the primary semiconductor light source 404 during operation. The electric lamp furthermore comprises a secondary semiconductor light source 408 in thermal communication with a translucent secondary reflector 410. The secondary reflector 410 is configured for transferring away heat generated by the secondary semiconductor light source 408 during operation. In this particular embodiment, the primary and secondary reflectors 406 and 410 are mounted in a mutually substantially parallel configuration. Furthermore, in this particular example, the distance $d_1$ between the primary reflector 406 and the secondary reflector 410 amounts to 7 mm.

Preferably the primary and secondary reflectors 406 and 410 are manufactured from ceramic material, e.g. magnesium silicate. Owing to the significant electrical resistance of the latter material the primary and secondary reflectors 406 and 410 are enabled to perform as ceramic printed circuit boards, i.e. encompassing printed circuit boards, without installing further electrical insulation for that purpose. Herein, the primary and secondary semiconductor light sources 404 and 408 are situated on mutually opposite sides relative to the structure composed of the primary and secondary reflectors 406 and 410. The primary and secondary reflectors 406 and 410 are in electrical connection with a socket 412. Transparent optical chambers 416 and 418 are optionally mounted to the primary reflector 406 and the secondary reflector 410, respectively, for accommodating the primary and secondary semiconductor light sources 404 and 408. Preferably, the transparent optical chambers 416 and 418 are manufactured from a transparent ceramic material.

FIG. 5 schematically depicts an electric lamp 502 comprising a primary semiconductor light source 504 accommodated in a primary transparent optical chamber 506. The primary semiconductor light source 504 has a primary optical axis 508. The primary semiconductor light source 504 is thermally connected to a reflective primary reflector 510. The primary reflector 510 is capable both of reflecting light generated by the primary semiconductor light source 504 during operation and of transferring away heat generated by the primary semiconductor light source 504 during operational conditions. The electric lamp 502 furthermore comprises a secondary semiconductor light source 512 being accommodated in a secondary transparent optical chamber 514, having a secondary optical axis 516 and being in thermal communication with a reflective secondary reflector 518. The secondary reflector 518 is configured for reflecting light generated by the secondary semiconductor light source 512 during operation, as well as for transferring away heat generated by the secondary semiconductor light source 512 during operational conditions. The primary and secondary reflectors 510 and 518 are substantially curved. For increasing the ability to reflect light along a direction having a substantial component parallel to the primary and secondary optical axes 508 and 516, the primary and secondary reflectors 510 and 518 are concave with respect to the primary and secondary semiconductor light sources 504 and 512, respectively. The primary and secondary reflectors 510 and 518 are mechanically connected to a socket 520.

FIG. 6 schematically displays an electric lamp 602 comprising a primary semiconductor light source 604 having a primary optical axis 606. The primary semiconductor light source 604 is thermally connected to a primary reflector 608. The primary reflector 608 is capable of transferring away heat generated by the primary semiconductor light source 604 during operational conditions. The electric lamp 602 furthermore comprises a secondary semiconductor light source 610 which has a secondary optical axis 612, and which is in thermal communication with a secondary reflector 614. The secondary reflector 614 is configured for transferring away heat generated by the secondary semiconductor light source 610 during operational conditions. For focusing light emitted in backward directions towards directions alike the primary and secondary optical axes 606 and 612, the primary and secondary reflectors 608 and 614 are provided with local indentations surrounding the primary and secondary semiconductor light sources 604 and 612, respectively. For the purpose of reflection, the primary and secondary reflectors 608 and 614 are reflective within said local indentations. Aside from said local indentations, the primary and secondary reflectors 608 and 614 are transparent. The primary and secondary reflectors 608 and 614 are mechanically connected to a socket 616.

FIG. 7A schematically depicts an electric lamp 702 by way of a bottom view. The electric lamp comprises a primary semiconductor light source 704 and a secondary semiconductor light source 706, which are mounted in thermal communication to a primary reflector 708 and a secondary reflector 710, respectively. Referring to FIG. 7B, the primary semiconductor light source 704 is provided with a primary optical axis 705 whereas the secondary semiconductor light source 706 has a secondary optical axis 707. The primary and secondary reflectors 708 and 710 are configured for both reflecting light generated during operation by the primary and secondary semiconductor light sources 704 and 706, and for transferring away heat from said primary and secondary semiconductor light sources 704 and 706, respectively. Referring to FIG. 7A, the electric lamp 702 furthermore comprises a third semiconductor light source 712 and a fourth semiconductor light source 714. The third and fourth semiconductor light sources 712 and 714 are in thermal communication with third and fourth reflectors 716 and 718, respectively. The primary and secondary reflectors 708 and 710 are configured for both reflecting light generated during operation by the primary and secondary semiconductor light sources 704 and 706, and for transferring away heat from said primary and secondary semiconductor light sources 704 and 706, respectively. As apparent from FIG. 7B, the primary and secondary reflectors 708 and 710 are substantially curved as to focus the light generated during operation by the primary and secondary semiconductor light sources 704 and 706 in particular directions. Preferably, the curvature of the primary and secondary reflectors is adjustable, e.g. by manufacturing the primary and secondary reflectors from a material allowing for significant plastic deformation, as to enable the focusing of light in any direction desired. All reflectors may be mechanically mounted to a socket 720.

While the invention has been illustrated and described in detail in the drawings and in the foregoing description, the illustrations and the description are to be considered illustrative or exemplary and not restrictive. The invention is not limited to the disclosed embodiments. It is noted that the system according to the invention and all its components can be made by applying processes and materials known per se. In the set of claims and the description the word "comprising" does not exclude other elements and the indefinite article "a" or "an" does not exclude a plurality. Any reference signs in the claims should not be construed as limiting the scope. It is further noted that all possible combinations of features as defined in the set of claims are part of the invention.

The invention claimed is:

1. An electric lamp comprising a primary semiconductor light source having a primary optical axis and positioned in thermal communication with and mounted to a primary reflector, wherein the primary reflector is plate-like in configuration, extending in a predetermined plane that is transverse to said primary optical axis, and is reflective, transparent and/or translucent, and configured for transferring heat generated by the primary semiconductor light source during operation away from said primary semiconductor light source, and a cage for mechanically connecting the primary reflector to a socket.

2. The electric lamp according to claim 1, comprising a printed circuit board for facilitating thermal communication between the primary semiconductor light source and the primary reflector.

3. The electric lamp according to claim 1, comprising a secondary semiconductor light source in thermal communication with the primary reflector, wherein the primary and secondary semiconductor light sources are situated on mutually opposite sides relative to the primary reflector.

4. The electric lamp according to claim 1, comprising a secondary semiconductor light source in thermal communication with a secondary reflector, wherein the secondary reflector is reflective, transparent and/or translucent, and wherein secondary reflector is configured for transferring heat generated by the secondary semiconductor light source during operation away from said secondary semiconductor light source.

5. The electric lamp according to claim 4, wherein the primary reflector and the secondary reflector are mutually substantially parallel.

6. An electric lamp comprising:

a primary semiconductor light source in thermal communication with and mounted to a primary reflector, wherein the primary reflector is reflective, and wherein the primary reflector is configured for transferring heat generated by the primary semiconductor light source during operation away from said primary semiconductor light source;

a secondary semiconductor light source in thermal communication with a secondary reflector, wherein the secondary reflector is reflective, transparent and/or translucent, and wherein secondary reflector is configured for transferring heat generated by the secondary semiconductor light source during operation away from said secondary semiconductor light source, wherein the primary reflector and the secondary reflector are mutually substantially parallel, wherein a distance ($d_1$) between the primary reflector and the secondary reflector is larger than 6 mm and smaller than 8 mm.

7. An electric lamp comprising:

a primary semiconductor light source in thermal communication with and mounted to a primary reflector, wherein the primary reflector is transparent and/or translucent, and wherein the primary reflector is configured for transferring heat generated by the primary semiconductor light source during operation away from said primary semiconductor light source;

a secondary semiconductor light source in thermal communication with a secondary reflector, wherein the secondary reflector is reflective, transparent and/or translucent, and wherein secondary reflector is configured for transferring heat generated by the secondary semiconductor light source during operation away from said secondary semiconductor light source, wherein the primary reflector and the secondary reflector are mutually substantially parallel, wherein a distance ($d_1$) between the primary reflector and the secondary reflector is larger than 6 mm and smaller than 15 mm.

8. An electric lamp, comprising:

a primary semiconductor light source having a primary optical axis and positioned in thermal communication with and mounted to a primary reflector, wherein the primary reflector is plate-like in configuration, extending in a predetermined plane that is transverse to said primary optical axis, and is reflective, transparent and/or translucent, and wherein the primary reflector is configured for transferring heat generated by the primary semiconductor light source during operation away from said primary semiconductor light source;

a secondary semiconductor light source in thermal communication with a secondary reflector, wherein the secondary reflector is reflective, transparent and/or translucent and wherein secondary reflector is configured for transferring heat generated by the secondary semiconductor light source during operation away from said secondary semiconductor light source, wherein the primary semiconductor light source situated on a side of the primary reflector facing away from the secondary reflector, and wherein the secondary semiconductor light source is situated on a side of the secondary reflector facing away from the primary reflector.

9. The electric lamp according to claim 1, wherein the primary reflector comprises a covered surface area which is covered by the primary semiconductor light source and a further surface area, and wherein the further surface area is larger than the covered surface area.

10. The electric lamp according to claim 1, wherein the primary reflector comprises ceramic material.

11. The electric lamp according to claim 10, wherein the primary reflector is configured for performing as a ceramic printed circuit board.

12. The electric lamp according to claim 1, comprising a primary transparent optical chamber mounted to the primary reflector for accommodating the primary semiconductor light source.

13. The electric lamp according to claim 12, wherein the primary transparent optical chamber comprises transparent ceramic material.

* * * * *